US006943770B2

(12) United States Patent
Garcia et al.

(10) Patent No.: US 6,943,770 B2
(45) Date of Patent: Sep. 13, 2005

(54) METHOD AND SYSTEM FOR LCD PANEL LIGHT SOURCE SELECTION

(75) Inventors: Marcella A. Garcia, Austin, TX (US); Eugen Munteanu, Austin, TX (US); Stefan Peana, San Diego, CA (US)

(73) Assignee: Dell Products L.P., Round Rock, TX (US)

( * ) Notice: Subject to any disclaimer, the term of this patent is extended or adjusted under 35 U.S.C. 154(b) by 355 days.

(21) Appl. No.: 10/324,696

(22) Filed: Dec. 19, 2002

(65) Prior Publication Data

US 2004/0119679 A1 Jun. 24, 2004

(51) Int. Cl.[7] ..... G09G 3/36
(52) U.S. Cl. ..... 345/102
(58) Field of Search ..... 345/68–70, 102, 345/211–212; 349/61, 68

(56) References Cited

U.S. PATENT DOCUMENTS 5,854,617 A * 12/1998 Lee et al. ..... 345/102
6,359,392 B1 3/2002 He ..... 315/291
6,462,941 B1 10/2002 Hulick et al. ..... 361/683
6,483,245 B1 11/2002 Weindorf et al. ..... 315/82
6,496,236 B1 * 12/2002 Cole et al. ..... 349/61
2003/0067436 A1 * 4/2003 Hara et al. ..... 345/102
2004/0100789 A1 * 5/2004 Ju ..... 362/31

* cited by examiner

*Primary Examiner*—Richard Hjerpe
*Assistant Examiner*—Rodney Amadiz
(74) *Attorney, Agent, or Firm*—Hamilton & Terrile, LLP; Robert W. Holland

(57) ABSTRACT

A method and system selects between a LED light source and an electroflorescent light source, such as a CCFL light source, to illuminate a LCD panel that displays information generated by an information handling system. A light source controller selects one or both of LED and CCFL light sources to illuminate the LCD panel based on one or more predetermined factors, such as the power consumption of the light source for a selected display brightness. In one embodiment, the light source controller preserves battery power of a portable information handling system by selection of one of the light sources based on a determination of which light source will consume the least power for a selected display brightness level.

17 Claims, 3 Drawing Sheets

METHOD AND SYSTEM FOR LCD PANEL LIGHT SOURCE SELECTION

BACKGROUND OF THE INVENTION

1. Field of the Invention

The present invention relates in general to the field of displaying information, and more particularly to a method and system for LCD panel illumination light source selection.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

One aspect of information handling systems that has proven useful is the portability provided by portable or laptop systems. Portable information handling systems typically pack the functionality of a fixed desktop system into a smaller an more light weight chassis that is easily carried by users. Portable information handling systems typically include a foldable display integrated in a hinged lid that opens when the system is in use to display information and that closes when the system is not in use for protection within a compact package. For instance, a liquid crystal display (LCD) panel displays information by manipulating LCD pixels to effect the passage of light through the pixels. In order to display information on an LCD panel of a portable information handling system, a light source is generally disposed behind the LCD pixels so that the LCD pixels are illuminated with sufficient brightness. One type of light source used to illuminate an LCD display is an electroflorescent light source, such as a cold cathode florescent lamp (CCFL). CCFL light sources generate light with an alternating current (AC) that excites a florescent plasma isolated in a tube. Another type of light source used to illuminate an LCD panel is a light emitting diode (LED) light source. LED light sources generate light with a direct current (DC) applied to red, green and blue LEDs that combine to produce white light.

One difficulty with portable information handling systems is that true portability typically requires an internal power source such as a battery that carries a charge of limited duration. Portable information handling systems typically interface with an external power source, such as an AC wall jack, that recharges the internal battery. When a portable information handling system is interfaced with an external power source, power consumption of electronic components is not of particular concern. However, when a portable information handling system is powered only by its internal battery, excessive power consumption can have a significant impact on the duration of a battery charge. For instance, when a portable information handling system operates on its internal battery, it typically operates in a lower power mode that conserves battery power by shutting off the LCD display after a predetermined period of non-use. An LCD panel draws considerable power from the battery, so any improvements to the power-use efficiency for an LCD panel of an information handling system will typically result in substantially prolonged battery charge duration.

SUMMARY OF THE INVENTION

Therefore a need has arisen for a method and system which improves the power use efficiency of an LCD panel.

In accordance with the present invention, a method and system are provided which substantially reduce the disadvantages and problems associated with previous methods and systems for display of information by an LCD panel. The LCD panel illuminates LCD pixels with a light source or light sources selected between plural light sources, such as an LED light source and an electroflorescent light source. The light source selection is based on one or more predetermined factors, such as the brightness selected for the display, the efficiency of the light sources at the selected brightness, the power source providing power to the light sources, and the charge available in the power source.

More specifically, a portable information handling system displays information with a LCD panel having a LED light source and a CCFL light source for illuminating the LCD pixels. A light source controller interfaces with the LED light source, the CCFL light source and the power source of the portable information handling system to select the light source or light sources for illumination of the LED pixels. If the portable information handling system is powered by an internal battery power source, the light source controller selects the one of the LED and CCFL light sources that will illuminate the LCD panel with the least power consumption. If the portable information handling system internal battery power source reaches a predetermined low power state, the light source controller switches to a low power consumption mode, such as by illumination with the LED light source at a low brightness level. If the portable information handling system is powered by an external power source, the light source controller illuminates the LCD panel to obtain a display of a desired quality, such as with one or both of the LED and CCFL light sources.

The present invention provides a number of important technical advantages. One example of an important technical advantage is that the use of two light sources for LCD panel illumination allows selection of a light source for a display brightness level that will reduce power consumption and improve battery charge duration. For instance, a LED light source operates on DC power and is most efficient at low brightness levels. In contrast, a CCFL light source operates on AC power and is most efficient at high brightness levels. The light source controller selects the most efficient of the LED and CCFL light sources for a given brightness level to reduce power consumption and improve battery charge duration for the selected brightness level.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Effective power consumption management during use of portable information handling systems prolongs the operating time for internal power sources, such as battery power sources. The present invention improves display quality and battery life by selecting between light sources of an LCD panel to display information from an information handling system. For purposes of this application, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
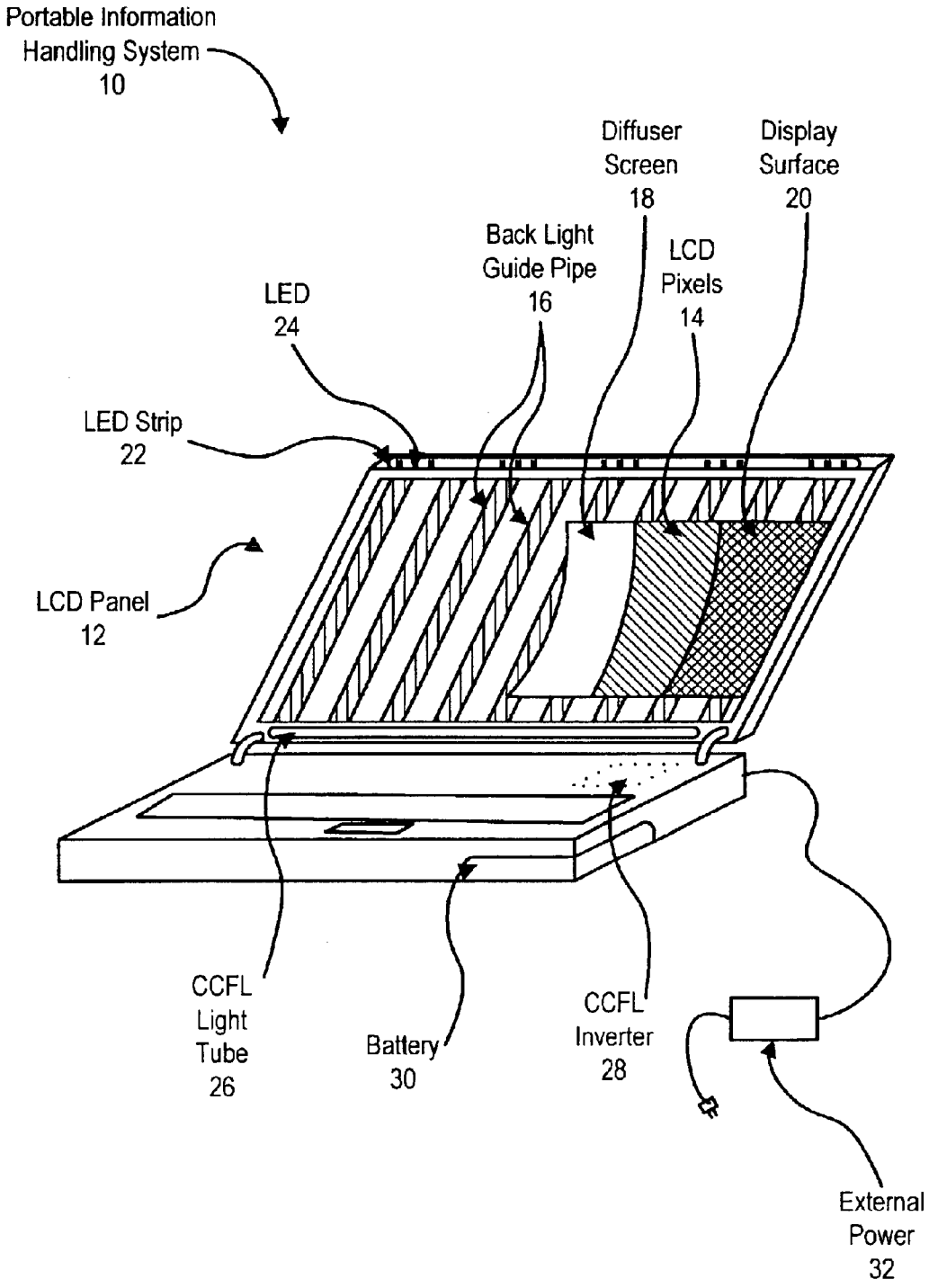
FIG. 1 depicts an information handling system configured for light source selection.

Referring now to FIG. 1, a perspective cutaway view depicts a portable information handling system 10 configured to select the light source that illuminates an LCD panel 12. Information generated by information handling system 10 is displayed on LCD panel 12 through LCD pixels 14, which create letters and graphics in response to signals received from information handling system 10. LCD pixels 14 are illuminated by light provided from back light guide pipes 16 that is diffused for a more even distribution of light by a diffuser screen 18. LCD pixels selectively block colors of the illumination light provided from back light guides 16 so that light associated with unblocked colors passes through a protective display surface 20 to display information.

LCD panel 12 provides light to back light guide pipes 16 for illuminating LCD pixels 14 from two separate light sources. The first light source is an LED strip 22 disposed perpendicular to the back light guide pipes 16 along the upper portion of LCD panel 12. LED light strip 22 generates white light for illumination of back light guides 16 with a series of red, green and blue LEDs disposed in LED light strip 22. The second light source is a CCFL light tube 26 disposed perpendicular to the back light guide pipes 16 along the bottom portion of LCD panel 12. CCFL light tube 26 generates light with an alternating current provided by CCFL inverter 28. CCFL inverter 28 converts direct current available from a power bus of portable information handling system 10 to create an alternating current of sufficient voltage to initiate the plasma within CCFL light tube 26. In contrast, LED light strip 22 generates light from direct current. Power for operating portable information handling system 10, including light sources 22 and 26, is available from an internal battery power source 30 or from an external power source 32. Internal battery power source 30 is operable to power portable information handling system 10 for a limited duration and then is recharged with external power source 32. The duration of internal battery power source 30 depends upon the rate at which power is drawn for operating portable information handling system 10.

Light sources 22 and 26 impact the duration of a charge of internal battery power source 30 at various rates depending upon the brightness at which LCD panel 12 illuminates information. For instance, brightness levels for the illumination of information by LCD panel 12 are selectable through keyboard 34, such as by selection of the function and up arrow key for greater brightness and selection of the function and down arrow key for decreased brightness. CCFL light tube 26 draws more power than LED light strip 22 at reduced brightness levels since CCFL light tube 26 uses a relatively high alternating current voltage to initiate its plasma even at low brightness selections whereas LED light strip 22 uses direct current. However, LED light strip 22 draws more power than CCFL light tube 26 at increased brightness levels since the electroflorescent light generation technique of CCFL light tube 26 is more efficient than the direct current light generation technique of LED light strip 22 at increased brightness levels. In one embodiment, CCFL light tube 26 becomes more efficient for illumination of LCD panel 12 once illumination with LED light strip 22 for a selected brightness level draws approximately 2.5 or more watts of power.

Figure 2:
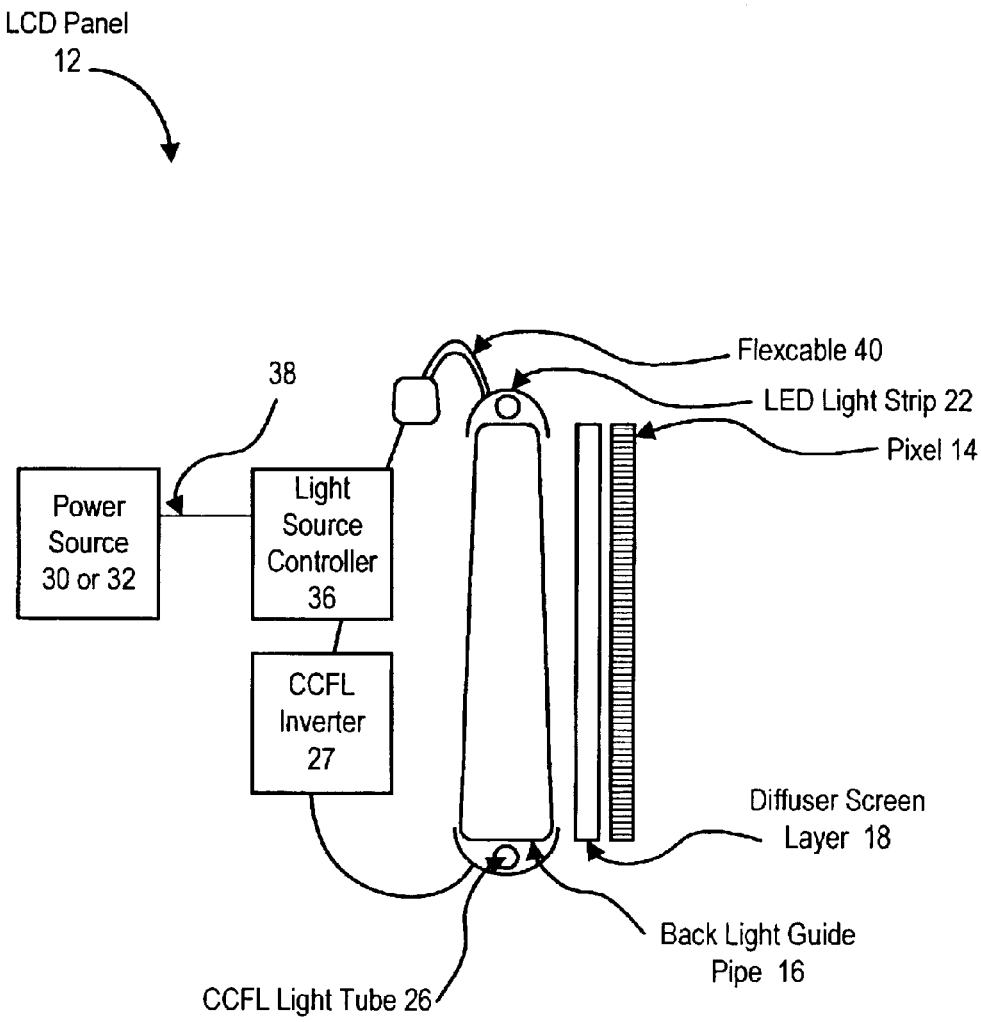
FIG. 2 depicts a side cutaway view of an LCD panel configured to select illumination from one or both of a LED or CCFL light source.

Referring now to FIG. 2, a side cutaway view of LCD panel 12 depicts a light source controller 36 operable to select between light sources 22 and 26 for providing illumination to pixels 14 through back light guide pipe 16 and diffuser screen 18. Light source controller 36 selects between one or both of light sources 22 and 26 for illuminating back light guide pipe 16 based on one or more factors, such as the power source in use, the remaining duration of an internal power source, the selected level of display brightness and the desired level of display quality for LCD panel 12. For instance, light source controller interfaces with power bus 38 to determine whether an internal power source 30 or external power source 32 is in use and to determine the remaining charge of internal power source 30. Light source controller 36 allocates power to CCFL inverter 28 or to LED light strip 22 through a flex cable 40 so that back light guide pipe 16 illuminates LCD pixels 14 at a selected brightness level. If the brightness level selection or other factors changes, such as through a user input to keyboard 34 to change brightness or a change to the power source as external or internal, light source controller 36 resets the back light illumination source based on the changed factors.

Figure 3:
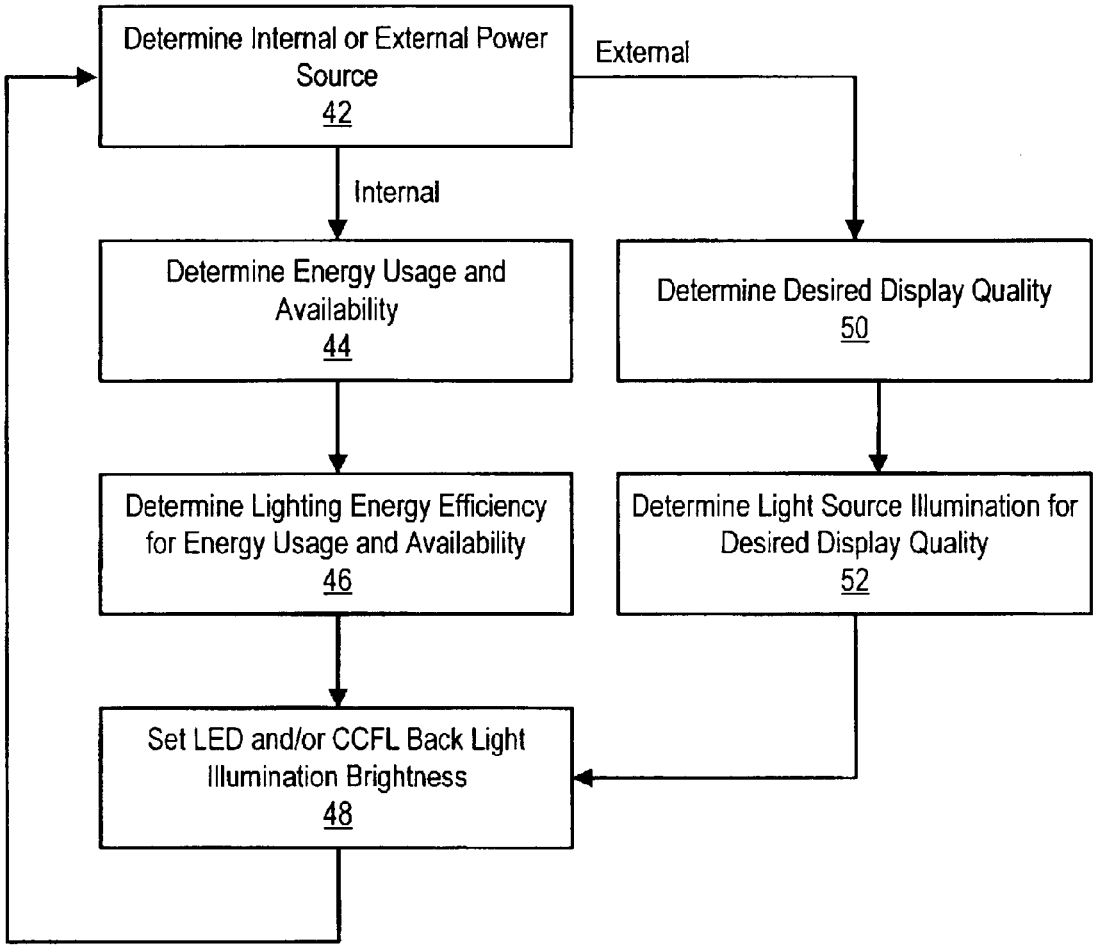
FIG. 3 depicts a process for selecting between light sources to reduce power consumption.

Referring now to FIG. 3, a flow diagram depicts a process for selecting between illumination light sources for illuminating LCD panel 12. The process begins at step 42 with a determination of the power source as the internal battery or external power source. If portable information handling system 12 operates on a power source with a limited duration, such as an internal battery, then the process continues to step 44 for a determination of the energy usage for illumination and the energy availability, such as the charge remaining on the battery. The energy usage is determinable, for instance, by measuring the average current used by the selected light source or light sources to provide illumination. The selected brightness is determinable by the average current used to provide illumination and the light source or light sources selected for illumination.

At step 46, a determination is made of the lighting energy efficiency for the selected brightness and power availability. For instance, at an average power use value or value range, such as approximately 2.5 watts or below, LED light strip 22 is provided power, and at greater average power use values, such as average power use of greater than approximately 2.5 watts, CCFL light tube 26 is provided power. The determination of the average power use for switching from a selected light source to the other light source is based on the efficiency of each available light source for the selected brightness level. However, in one embodiment, low power availability, such as with a low remaining battery charge, results in selection of a low power use state, such as a very dim display illuminated by the LED light source, to reduce power consumption while the user shuts down the information handling system or connects an external power supply. Once the determination is made of the lighting energy efficiency, at step 48 the LED and/or CCFL back light illumination brightness is set by providing power to the selected light source at the selected power level.

If a step 42 the determination is made that an external power source is in use, then power consumption has reduced importance relative to display quality. At step 50, a determination is made of a desired display quality. For instance, under various external conditions or with various LCD panel components, one light source may be preferable to another, or selection of both light sources may be preferred. At step 52, light source controller 36 determines the light source or light sources for illumination of a desired display quality. As one example, in outdoor lighting conditions, light source controller 36 may use both CCFL light tube 26 and LED light strip 22 with selected current allocations to provide a bright display illumination. As another example, various diffuser screen layers 18 may provide variable diffusion quality with certain indoor lighting conditions so that light source controller 36 selects one light source at a brightness level in which selection of the other light source would be more efficient. For instance, in one embodiment the LED red, green and blue lights are illuminated at varying intensity to superimpose the selected LED light color over the CCFL white light to enhance the color gamut or create color shifts. In another embodiment, one or more light sources are strobed to enhance an image. Although these additional effects are available with external power, in some situations a user may override the battery consumption considerations to use these effects when on operating on battery power. Once the determination of the light source or light source is made, at step 48 the LED and/or CCFL back light illumination brightness is set with an appropriate current directed to the selected light source.

At step 48, changes to LED or CCFL back light illumination brightness sometimes results in switching a presently selected light source off and switching the other newly selected light source on. One method for switching light sources that helps to reduce energy use is to transition illumination from the selected light source to the other newly selected light source gradually. For instance, selection from the CCFL to the LED light source is accomplished by dimming the CCFL brightness while simultaneously increasing the LED brightness until the CCFL light source is off and the LED light source has illuminated the LCD panel at the selected brightness level. This gradual transition helps to make the change between light sources imperceptible to the user. Alternatively, one light source is turned on at a desired brightness while the other light source is simultaneously turned off. In other alternative embodiments, the newly selected light source is turned on to the desired brightness before the previously selected light source is turned off for an overlapping of illumination, or the newly selected light source is turned on to the desired brightness after the previously selected light source is turned off to avoid overlapping of illumination sources.

Although the present invention has been described in detail, it should be understood that various changes, substitutions and alterations can be made hereto without departing from the spirit and scope of the invention as defined by the appended claims.

What is claimed is:

1. An information handling system LCD panel comprising:

a LCD layer having plural liquid crystal pixels operable to display information;

a back light layer having plural light guide pipes operable to project light through the liquid crystal pixels;

a first light source interfaced with the back light layer to project light at one or more levels through the guide pipes;

a second light source interfaced with the back light layer to project light at one or more levels through the guide pipes; and a light source controller interfaced with the first and second light sources, the light source controller operable to select the light level projected from the light sources based on one or more predetermined factors;

wherein the one or more predetermined factors comprises an automated system shutdown at a low battery power level, the light source controller further operable to select a light source and light source level associated with reduced power consumption for projecting light during the automated system shutdown.

2. The information handling system LCD panel of claim 1 wherein the first and second light sources comprise a LED light source and an electroflorescent light source.

3. The information handling system LCD panel of claim 1 wherein the one or more predetermined factors comprises the type of power source in use by an associated information handling system.

4. The information handling system LCD panel of claim 1 wherein the light source selected at automated system shutdown is an LED light source.

5. The information handling system LCD panel of claim 1 wherein the one or more predetermined factors comprises the brightness selected for the panel.

6. The information handling system LCD panel of claim 5 wherein the first and second light sources comprise a LED light source and a CCFL light source, the light source controller operable select the LED light source and deselect the CCFL light source for brightness selections below a predetermined level.

7. The information handling system LCD panel of claim 5 wherein the first and second light sources comprise a LED light source and an electroflorescent light source, the light source controller operable to select a brightness level to switch between the LED and electroflorescent light sources so that energy consumption of the LCD panel is reduced.

8. The information handling system LCD panel of claim 7 wherein the light source controller is operable to determine brightness level from average current used by the LED or electroflorescent light source.

9. The information handling system LCD panel of claim 8 wherein the brightness level to switch between the LED and electroflorescent light sources corresponds to approximately 2.5 watts.

10. A method for displaying information on an LCD, the method comprising:

generating information for display with pixels of the LCD;

determining a brightness level selected for display of the information;

selecting a CCFL light sources to illuminate the pixels;

illuminating the pixels with the selected light source;

illuminating the pixels with a LED light source simultaneously with the CCFL light source.

11. The method of claim 10 wherein illuminating the pixels with a LED light source further comprises:

illuminating red, green or blue light sources of the LED light source at varying intensities to superimpose a red, green or blue light over the light provided by the CCFL light source.

12. A portable information handling system comprising:

a processor operable to generate information for display;

a LCD panel interfaced with the processor and operable to display information generated by the processor at selectable brightness levels;

an LED light operable to illuminate the LCD panel;

a CCFL light operable to illuminate the LCD panel;

a battery operable to power the LED light and the CCFL light; and a light source controller interfaced with the LED light and the CCFL light and operable to select one of the LED and CCFL light sources to illuminate the LCD panel at a selected brightness level that consumes the least battery power, the light source controller further operable to select simultaneous illumination by both the LED and CCFL light sources.

13. The portable information handling system of claim 12 further comprises:

an external power source operable to power the LED and CCFL light sources;

wherein the light source controller is further operable to detect that the external power source is providing power to illuminate the LCD panel and to illuminate the LCD panel with the one or both of the LED and CCFL light sources that displays the information with quality.

14. The portable information handling system of claim 12 wherein the light source controller is further operable to detect changes to the selected brightness level and to re-select a one of the LED and CCFL light sources to illuminate the LCD panel at the changed brightness level that consumes the least power.

15. The portable information handling system of claim 12 further comprising:

an external power source operable to interface with and recharge the battery;

wherein the light source controller is further operable to detect the external power source and to select both the CCFL and LED light sources when the external power source interfaces with the battery.

16. The portable information handling system of claim 15 wherein the LED light source comprises red, green and blue light sources that combine to produce white light and wherein the light source controller is further operable to illuminate the red, green and blue light sources at varying intensities to superimpose a red, green or blue light over light provided by the CCFL light source.

17. The portable information handling system of claim 15 wherein the light source controller comprises strobes of a light source over the illumination from the other light source.

* * * * *